United States Patent [19]

Wilkinson

[11] Patent Number: 4,659,075

[45] Date of Patent: Apr. 21, 1987

[54] DEVICE FOR SIMULATION OF CLIMBING

[76] Inventor: William T. Wilkinson, c/o Connolly and Hutz, P.O. Box 2207, Wilmington, Del. 19899-2207

[21] Appl. No.: 807,797

[22] Filed: Dec. 11, 1985

Related U.S. Application Data

[60] Division of Ser. No. 541,879, Oct. 14, 1983, which is a continuation-in-part of Ser. No. 388,881, Jun. 16, 1982, Pat. No. 4,561,652, which is a continuation-in-part of Ser. No. 235,419, Feb. 17, 1981, Pat. No. 4,340,218.

[51] Int. Cl.[4] ..... A63B 21/00

[52] U.S. Cl. ..... 272/70; 272/132

[58] Field of Search ..... 272/70, 70.2, 73, 131, 272/132, 133, 109, 62, 145; 128/25 R; 182/156, 165–177

[56] References Cited

U.S. PATENT DOCUMENTS

| | | | |
|---|---|---|---|
| 3,381,958 | 5/1968 | Golland | 272/73 |
| 3,747,924 | 7/1973 | Champoux | 272/70 |
| 3,792,860 | 2/1974 | Selnes | 272/70 X |
| 3,848,870 | 11/1974 | Craig | 272/73 X |
| 3,970,302 | 7/1976 | McFee | 272/70 X |
| 4,089,084 | 5/1978 | Droz | 182/165 X |
| 4,229,001 | 10/1980 | Roman | 272/131 X |

FOREIGN PATENT DOCUMENTS

| | | | |
|---|---|---|---|
| 241302 | 2/1961 | Australia | 182/165 |
| 523174 | 4/1931 | Fed. Rep. of Germany | 272/70 |
| 7713924 | 12/1976 | Netherlands | 272/70 |
| 2027598 | 2/1980 | United Kingdom | 272/70 |

*Primary Examiner*—Richard J. Apley
*Assistant Examiner*—Robert W. Bahr
*Attorney, Agent, or Firm*—Harold Pezzner

[57] ABSTRACT

A device for the partial simulation of climbing includes a frame having a vertically adjustable step and an upstanding handle to permit the user to simulate climbing by stepping up and down the step. Continuous or full simulation of climbing is achieved by a device which has vertically movable steps so that the user may remain at one location while continuously going through the motions of stepping upward.

4 Claims, 38 Drawing Figures

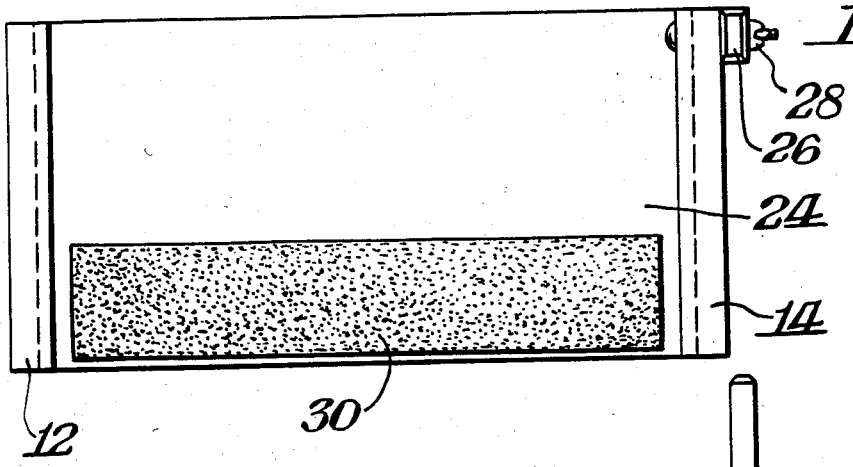
Fig. 3.
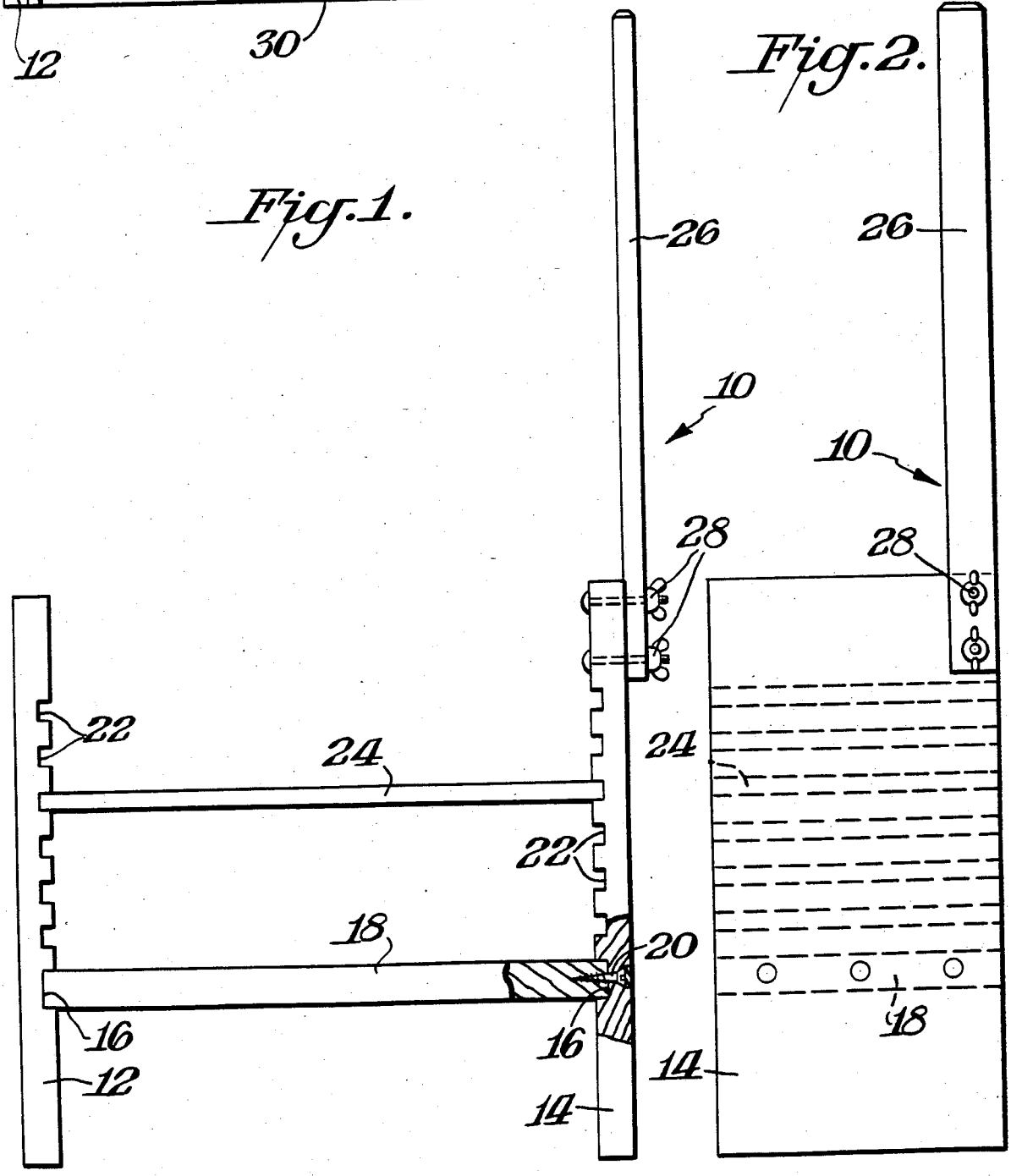
Fig. 1.
Fig. 2.

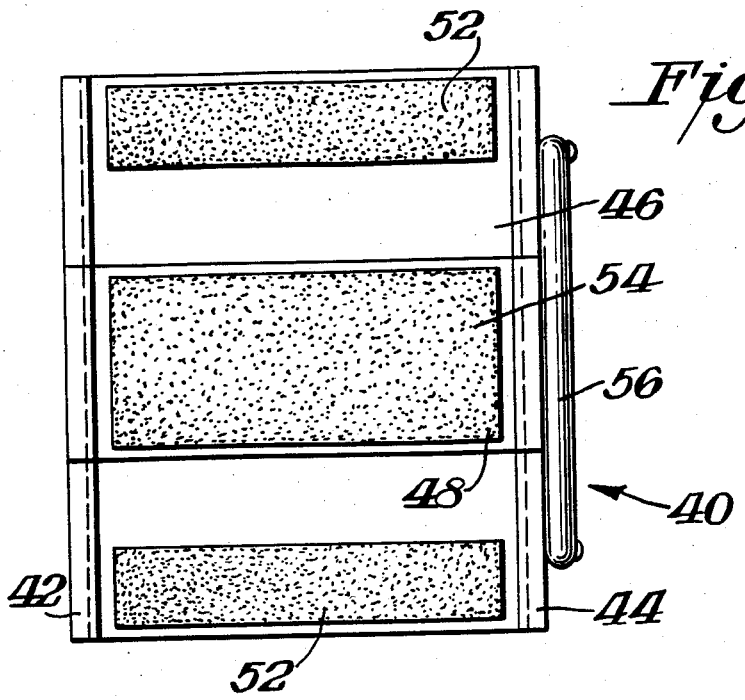
Fig. 10.
Fig. 8.
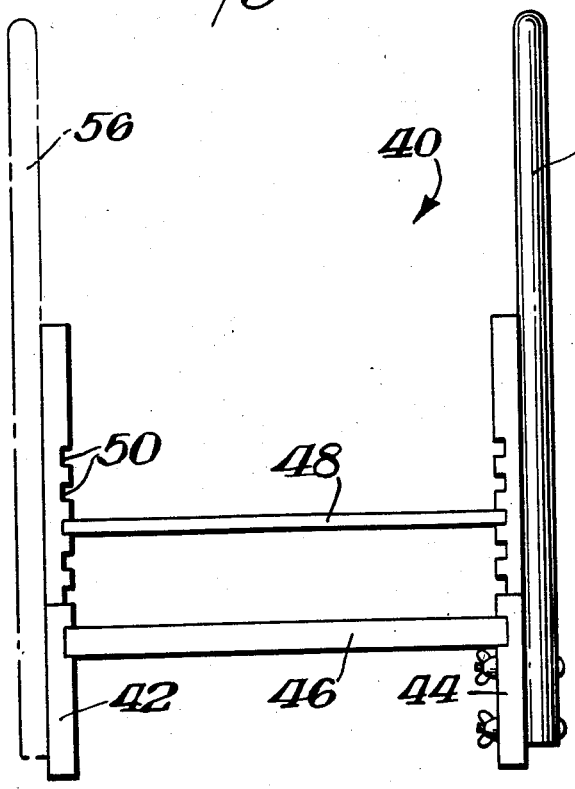
Fig. 9.
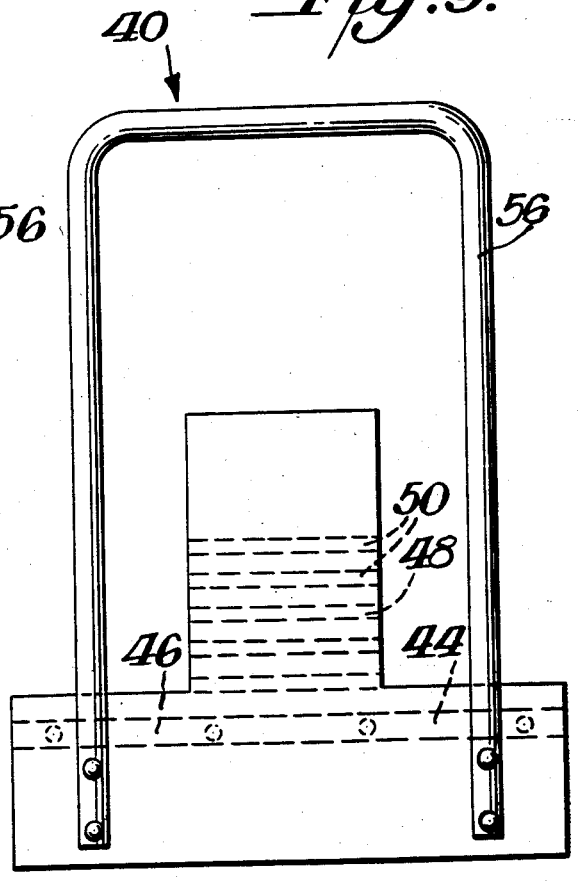

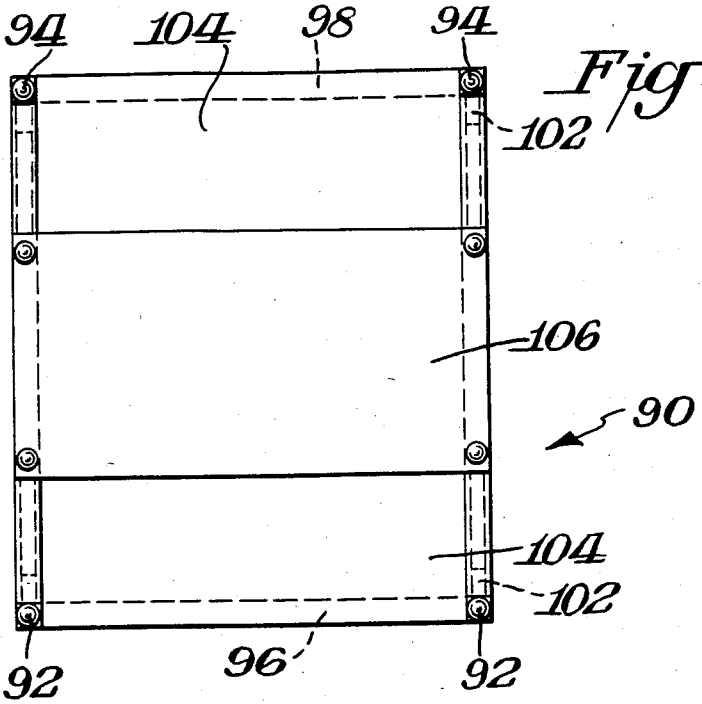
Fig. 16.
Fig. 14.
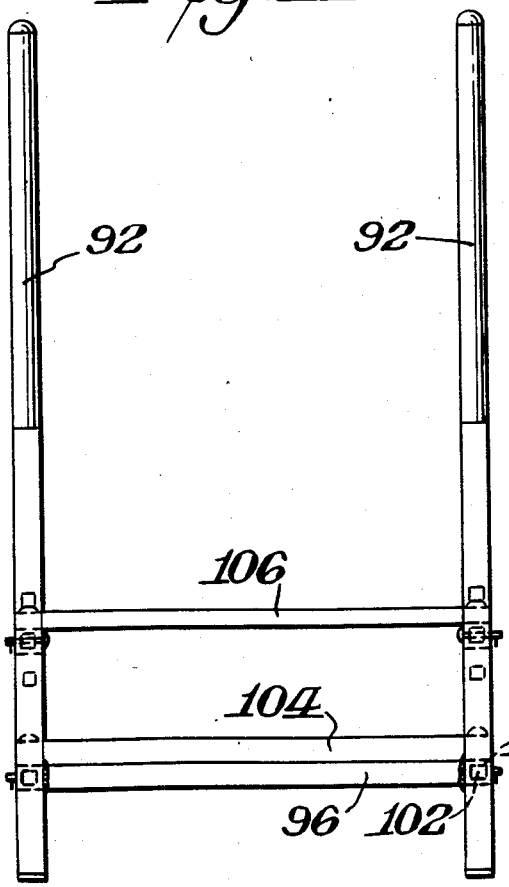
Fig. 15.
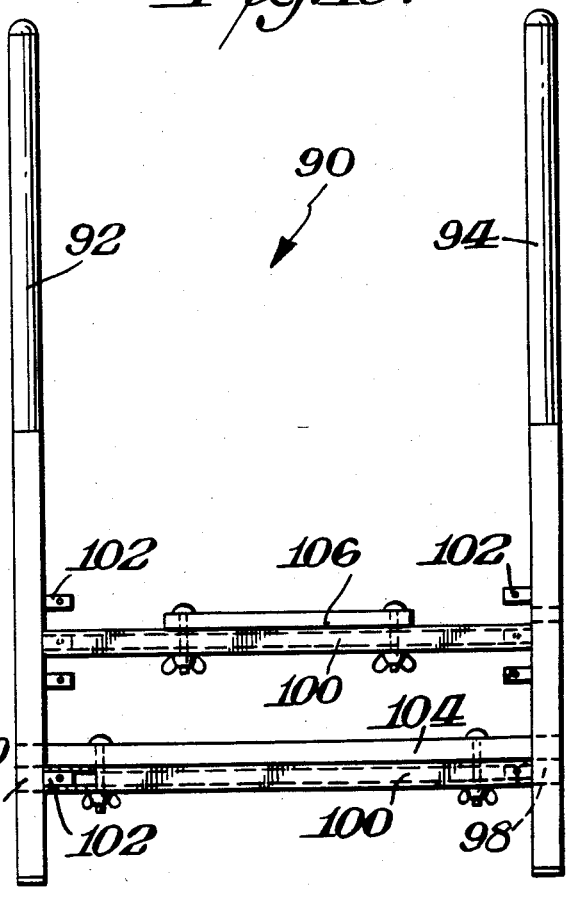

186

184
184
188
190

186

190
190
188
188
184
180
180
184
184
182
182
182
186

240
242
244
246
248
250
252
254
256
258
260
262
264

DEVICE FOR SIMULATION OF CLIMBING

CROSS-REFERENCE TO RELATED APPLICATIONS

This application is a division of application Ser. No. 541,879, filed Oct. 14, 1983, now abandoned, which is a continuation-in-part of application Ser. No. 388,881 filed June 16, 1982 now U.S. Pat. No. 4,561,652 which in turn is a continuation-in-part of application Ser. No. 235,419 filed Feb. 17, 1981 and now U.S. Pat. No. 4,340,218.

BACKGROUND OF INVENTION

Various forms of exercise such as swimming, jogging, cycling and rowing have been popular. An additional exercise which is rapidly gaining in popularity is climbing. In fact, climbing has a number of distinct advantages over these other forms of exercise.

For example with climbing the limbs primarily involved in the exercise are used throughout a relatively large range of motion. This produces greater energy expenditures for the total body.

Additionally a component of balance is included in the climbing activity. This forces the antagonist (anti-gravity muscles) and stabilizing muscle groups of the upper and lower body to play a more active role in the exercise.

There are or should be no impact forces encountered of any significance which means that overuse injuries should not occur. The nature of the rhythmic movement with controlled speed of stepping contributes to this. An abundant amount of medical and physiological data supports the negative aspects of jogging because of the jarring effects resulting from forces being transmitted from the ground, through feet, ankles, knees, hips and low-back. Joggers suffer from fallen arches, ankle sprains, shin splints, knee soreness, heel bone spurs, hip-point soreness and low back pain.

It is very difficult for the subject to rest or cheat during the climbing activity, unless it is intentional because it requires continuous coordinated movements with a metronome or rhythmic music.

Because of the relatively large vertical displacement of the body which inherently occurs in this activity, the level of intensity of exercises performed on the inventive device will generally be higher than other modes of workouts, resulting in higher overall point values.

A bicycle supports the user on a seat and reduces the use of the arms. This decreases the subject's energy expenditure. It has been estimated through research that oxygen uptake requirements are about fourteen percent lower in cycling than treadmill running because of the decreased anti-gravity work. Climbing utilizes all major muscle groups with the bench height about ten inches or a stepping rate greater than 25 steps per minute.

Swimming incorporates a bouyancy factor, thus reducing the energy expenditure. Climbing during the course of 25 minutes produces a greater energy expenditure than swimming for the average person, because most people cannot swim for 25 continuous minutes. Also, climbing strengthens the muscles of the legs—a process missing in swimming.

Although, as indicated above, climbing has a number of distinct advantages over other forms of exercise, there is one serious disadvantage in that it is not always convenient for someone to be able to perform the climbing exercise.

SUMMARY OF INVENTION

An object of this invention is to provide a device which enables the user to simulate climbing in a simple and convenient manner.

A further object of this invention is to provide a device for the partial simulating of climbing.

A still further object of this invention is to provide a device for the full or continuous simulation of climbing.

In accordance with this invention, the partial simulation of climbing is accomplished by means of a device in the form of a frame having an adjustable step so that the user can step up and down from the step. In the preferred practice of this invention, an upstanding handle is located at the step to facilitate the up and down movement. In a variation of this device, a plurality of such steps are provided at different elevations so that the user may step up and then down in the same direction and then turn around and repeat the climbing action.

In accordance with this invention a device is also provided for the full or continuous simulation of climbing wherein a pair of side-by-side steps are provided in such a manner that when the user steps with one foot on one step, that step is moved downwardly and then that step returns back up when the user steps on the other step.

THE DRAWINGS

FIG. 1 is a front elevation view partly in section of a climbing device in accordance with this invention for the partial simulation of climbing;

FIG. 2 is a side elevation view of the device shown in FIG. 1;

FIG. 3 is a top plan view of the device shown in FIGS. 1–2;

FIG. 8 is a front elevation view of yet another device in accordance with this invention;

FIG. 9 is a side elevation view of the device shown in FIG. 8;

FIG. 10 is a top plan view of the device shown in FIGS. 8–9;

FIG. 14 is a front elevation view of still yet another form of this invention;

FIG. 15 is a side elevation view of the device shown in FIG. 14;

FIG. 16 is a top plan view of the device shown in FIGS. 14–15;

DETAILED DESCRIPTION

Figure 6:
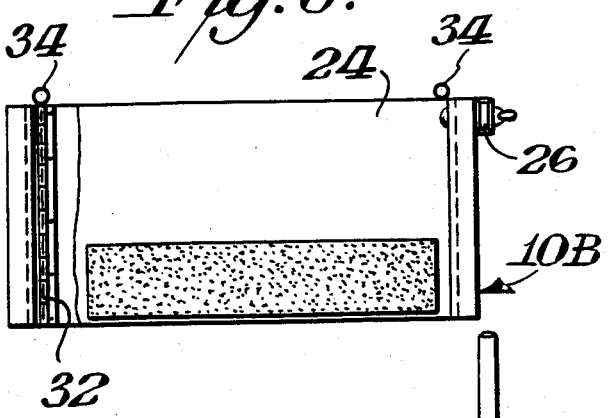
FIG. 6 is a top plan view partly broken away of the device shown in FIG. 5.

Parent application Ser. No. 388,881 filed June 16, 1982 and its parent application Ser. No. 235,419, now U.S. Pat. No. 4,340,218 (the details of which are incorporated herein by reference thereto) describe devices for the partial simulation of climbing. In this respect, in the use of these devices the user would step upwardly onto a platform or step portion of the device and then would be required to step down and repeat the stepping up and stepping down actions. These devices have the advantage of being portable so that they may be used in the most convenient manner.

The present invention is directed in part to other forms of devices for the partial simulation of climbing and in addition to devices for the full or continuous simulation of climbing. As later described, the differences between continuous simulation and partial simulation is that in partial simulation there is a stepping up and then stepping down whereas in continuous simulation the user is continuously in a stepping up motion, and the device itself permits this continuous stepping up motion to take place while the user remains at a fixed location.

FIGS. 1–3 show a device 10 in accordance with this invention for the partial simulation of climbing. As indicated therein, device 10 comprises five primary components, including a pair of side pieces 12, 14 made of wood or any other suitable material. Side pieces 12, 14 are provided with sets of grooves 16 into which is inserted a permanent support of base member 18 for forming a frame by joining the side pieces 12, 14 together. Base member 18 may be secured to side pieces 12, 14 in any suitable manner such as by screws 20 as illustrated in FIG. 1. Side pieces 12, 14 are also provided with different sets of grooves 22 for the selective insertion of a platform 24 which functions as a step. The height of step 24 may thus be selected by selection of the appropriate pair of grooves in the frame. If desired, for some users, platform or step 24 may be completely omitted, and base member 18 may function as the step. Although not illustrated, platform 24 may be secured in position by any suitable detachable fastener or may be held in position by the close tolerance in the dimensioning in the thickness of platform 24, and the corresponding spacing in the grooves 22.

Device 10 includes as a final component an upstanding handle 26 which may be a rod, bar or any other suitable device attached to one of the side pieces such as side piece 14 by suitable detachable fasteners such as bolts and nuts 28. Handle 26 provides the user with a balance during the climbing action.

As shown in FIG. 3, a portion of platform 24 may be provided with a non-skid surface 30. If desired, the non-skid surface may be provided over the entire upper portion of platform 24.

Device 10 has a number of distinct advantages. One such advantage is its versatility. In this respect, the adjustable height feature of platform 24 provides a variation of height within a range that allows any size person to use device 10 and in an exercise program to raise the height and thus achieve a progressively more strenuous exercise. The grooves 22 also provide device 10 with a manner of quick and easy adjustment of the step height. Device 10 is also formed of simple construction which permits low production cost so that device 10 can be priced at a level capable of being used by the general public. Moreover the simplified construction of device 10 does not detract from its strength and durability so that device 10 is both safe to use and long lasting. Additionally the simplified construction of device 10 makes the device fairly light weight and not cumbersome in shape while lending itself to convenience in assembly and disassembly so that device 10 may be readily portable and easily set up.

Tests done with the partial simulation device built in accordance with the concepts of device 10 have produced significant results when compared to other exercises. Specifically, climbing the device produces energy expenditures at the $17\frac{5}{8}''$ and $19\frac{5}{8}''$ heights with cadences of 25 and 30 steps per minute that are greater than jogging at $4–5\frac{1}{2}$ miles per hour. Climbing the device produces greater energy expenditures than does stationary cycling as practiced by the typical home fitness participant.

Exercise heart rates generated during use of the device on the $13\frac{3}{4}''$ to $19\frac{5}{8}''$ heights were 75–97 percent of the age-adjusted heart rates of the subjects. Recommended heart rate training levels are generally cited at 70–85%. Use of the device is a very strenuous exercise when coupled with the consistant cadence.

Use of the device will produce highly significant gains in aerobic and cardiovascular fitness levels of people if the device is used consistently on a weekly basis. The general recommendation is, of course, three to five days per week.

The conclusion reached as a result of these tests is the use of the device has to be considered a significant form of exercise modality that is superior to many other forms of exercise used by the general public.

Figure 4:
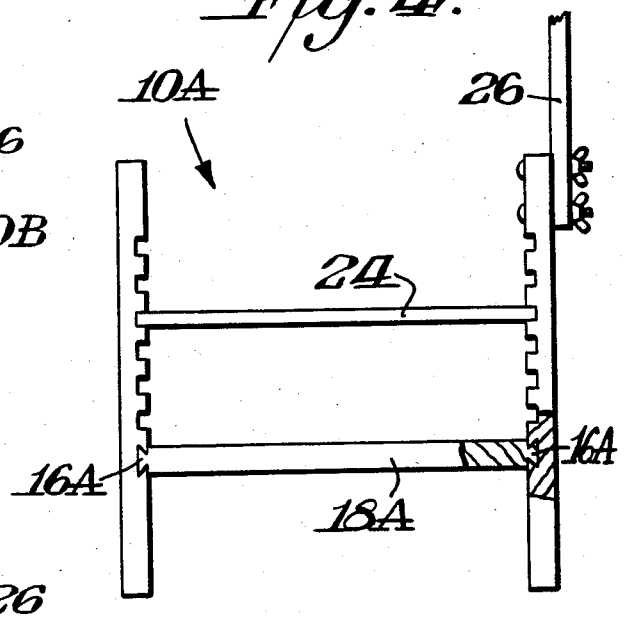
FIG. 4 is a front elevation view partly in section of a variation of the device shown in FIGS. 1–3.

The concepts for practicing this invention along the lines of the device 10 may be accomplished in various manners. For example, FIG. 4 shows a modification where device 10A includes dovetailed grooves 16A which would receive corresponding dovetailed sides of base member 18A so as to obviate the use of screws or other fasteners.

Figure 5:
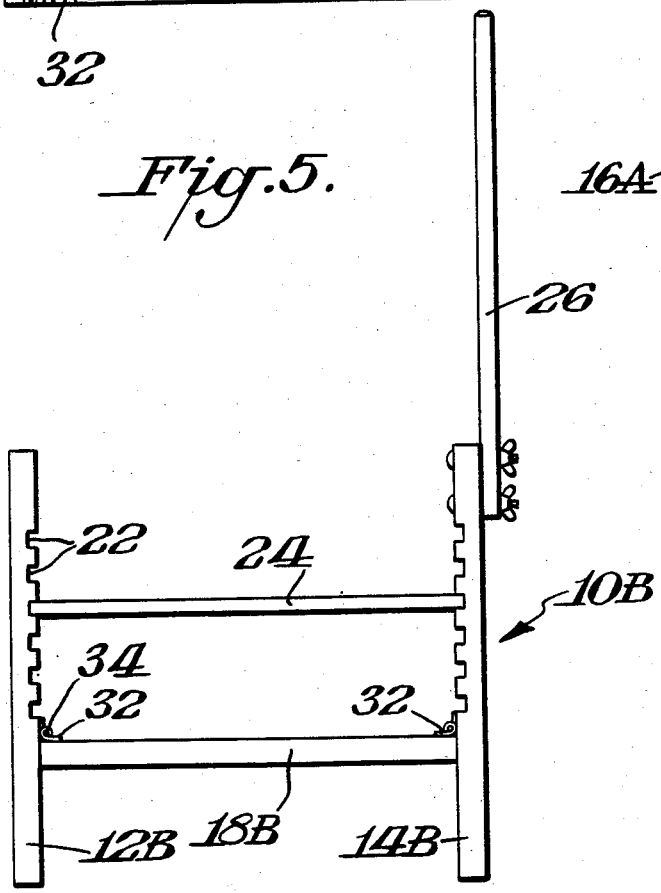
FIG. 5 is a front elevation in yet another variation of the device shown in FIGS. 1–3.
Figure 7:
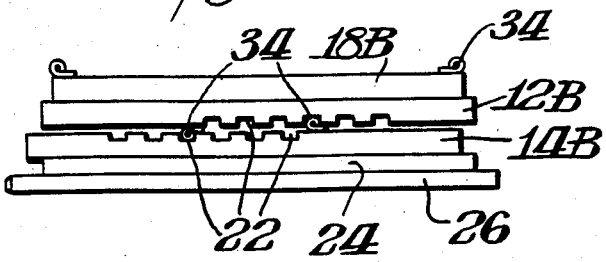
FIG. 7 is a front elevation view of the device shown in FIGS. 5–6 in the collapsed condition.

FIGS. 5–7 show yet another manner of constructing device 10B. In this variation, base member 18B and side members 12B and 14B are provided with elongated hinges 32 joined together by hinge pins 34. During the non-use or storage condition of the device, pins 34 would be removed from hinges 32 and handle 26 would be detached from side member 14B so that all of the components may be stored in a flat condition as illustrated in FIG. 7. In this collapsed condition, hinge pins 34 might be advantageously inserted into selective grooves 22.

The feature of being able to store the device in a flat collapsed condition is, of course, not limited to the embodiment of FIGS. 5–7. Thus in other variations of the device, the components may be disassembled atop each other in a manner similar to FIG. 7.

FIGS. 1–7 are particularly directed to a device having a single step. The invention, however, may be practiced by accomplishing partial simulation where a plurality of steps and particularly at least three steps are utilized so that the user would be stepping up and then down at more than one level. In this practice of the invention, a single step would be provided at a first level with a lower step provided on each side of the single step. FIGS. 8–10 illustrate one such form of this invention. As indicated therein, device 40 is constructed along the same principles as device 10 in that a frame is formed by side members 42, 44 with a base support 46 being inserted in corresponding grooves and with an upper platform 48 inserted into other sets of grooves 50. Device 40 differs from device 10, however, in that the frame is of greater length so that base member 46 provides an actual step member on each side of upper platform 48. Non-skid surfaces 52 may be provided at suitable locations on base member 46 with a non-skid surface 54 provided on upper step 48. The handle may be a single bar or rod similar to device 10 or may be an inverted U-shaped rail 56 as illustrated in FIGS. 8–10.

Device 40 may be considered as turn-around or up and over device in that the user would first step upwardly onto base member 46 and then step upwardly onto base member 48 and then step downwardly onto the other portion of base member 46. The user could then step downwardly off base member 46 and turn around and repeat the stepping actions or may turn around while on base member 46.

It is to be understood that although FIGS. 8–10 illustrate three steps, namely base member 46, upper member 48 and base member 46, the concepts of this invention may be practiced with any suitable number of steps, preferably an odd number by arranging the steps in pyramid style. For the sake of simplicity, however, only three such steps are illustrated.

Figure 13:
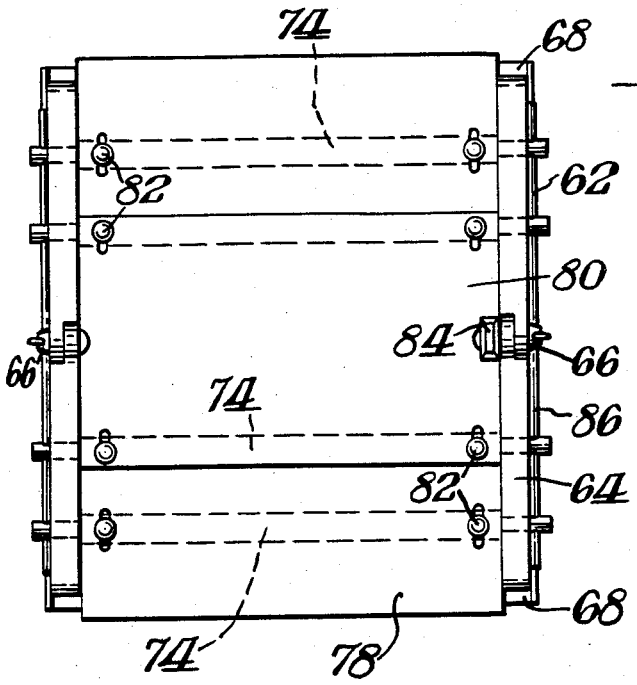
FIG. 13 is a top plan view of the device shown in FIGS. 11–12.
Figure 11:
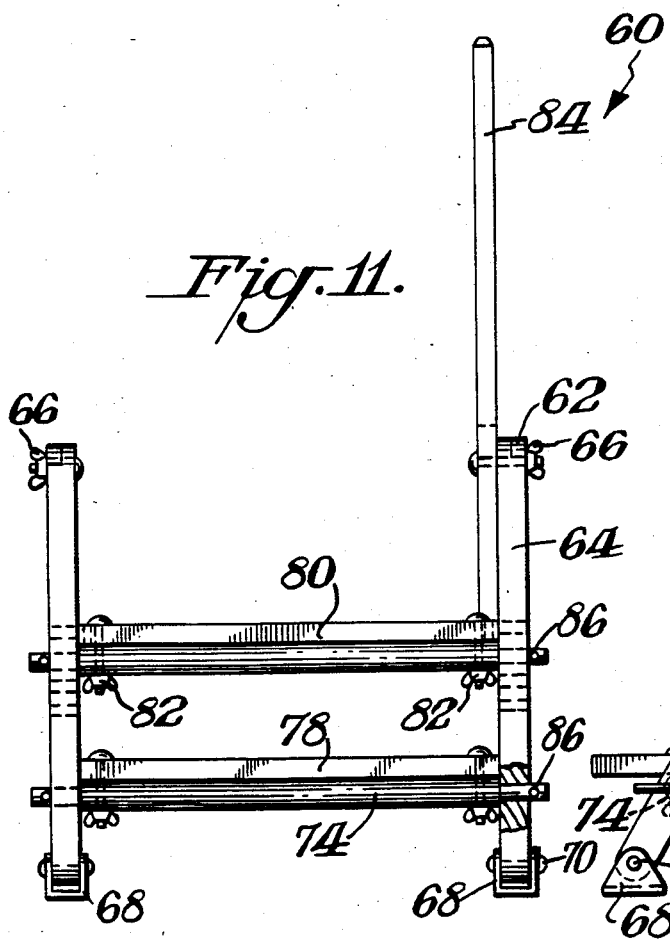
FIG. 11 is a front elevation view of yet another form of this invention.
Figure 12:
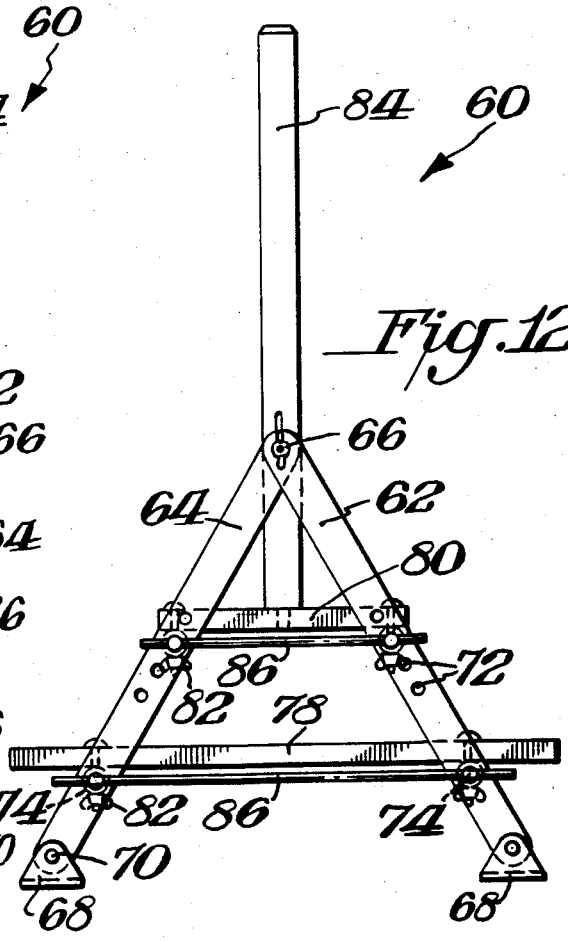
FIG. 12 is a side elevation view of the device shown in FIG. 11.

FIGS. 11–13 show a device 60 which is a variation of the turn-around or up and over partial simulation of climbing device. In this variation the frame is of A-shape in that each side member includes a pair of supports 62, 64 pivotally joined together at their upper ends by fastener 66. The lower ends of supports 62, 64 are provided with self-leveling feet 68 which freely pivot about pins 70. The sets of supports 62 and 64 are provided with corresponding holes 72 which may be utilized for securing support rods 74 across a set of supports 62, 64. Rods 86 extend through holes in sets of support rods 74. Steps 78 and 80 are secured to their respective support rods 74 by fasteners 82 which extend through slots in the steps. As with the other embodiment, a handle 84 would be secured to one of the side frames. For added stability additional supports 86 may connect bars or rods 74 together through the use of fasteners 88. Device 60 provides height selectivity in two different manners. Namely the spread or angulation of supports 62, 64 would affect the height of steps 78 and 80 as well as the selection of the appropriate holes 72.

FIGS. 14–16 show yet another device 90 further in accordance with the principles of devices 40 and 60. Device 90 includes as its frame members a pair of front and rear supports each of which is H-shaped in the form of a pair of front posts 92, 92 joined together by a base member 96. Similarly a pair of rear posts 94, 94 are also joined together by a base member 98. Members 96 and 98 may be secured to their respective posts by any suitable fasteners. The front posts 92, 92 are secured to the rear posts 94, 94 by stringers 100, 100 which are hollow and fit over selective flanges 102, 102. The stringers 100 function as bridge members for lower step 104 and upper step 106 which are detachably secured to the stringers in any suitable manner as best illustrated in FIG. 15. The lower platform 104 thus comprises a step on each side of upper platform 106. Posts 92, 94 may also function as handle members.

In accordance with another aspect of this invention, means are provided for the full or continuous simulation of climbing which would involve the user performing a continuous forward leg motion as in walking, running or cycling. Such devices for continuous climbing would employ, but not be limited to various current popular resistance mechanisms, such as hydraulic, pneumatic, "Universal", "Nautilus", resistance screws, friction brakes, tension springs, pulley and weights, etc. In general such continuous forward motion is accomplished by providing movable steps which move either vertically or in a circular direction.

Figure 19:
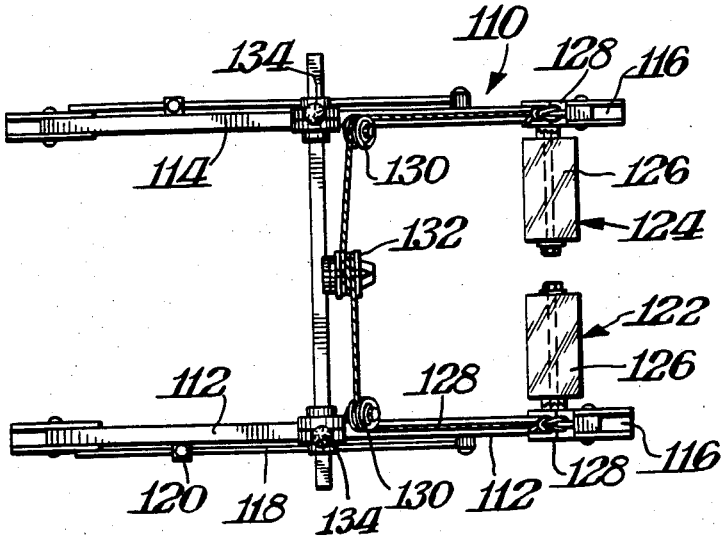
FIG. 19 is a top plan view of the device shown in FIGS. 17–18.
Figure 17:
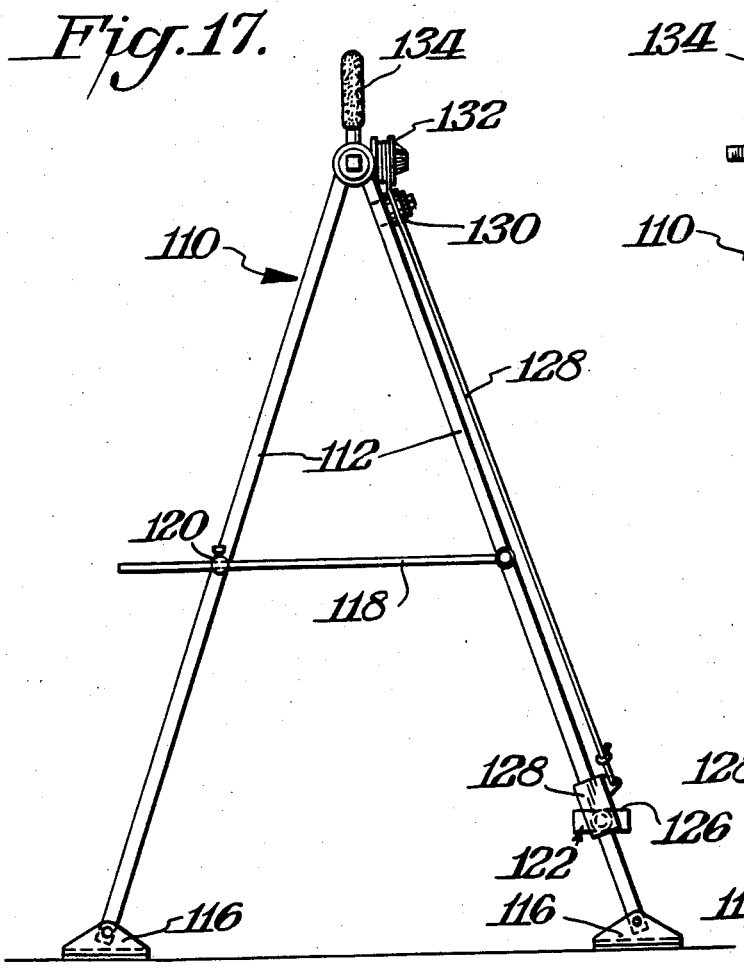
FIG. 17 is a side elevation view of the device in accordance with this invention for the continuous simulation of climbing.
Figure 18:
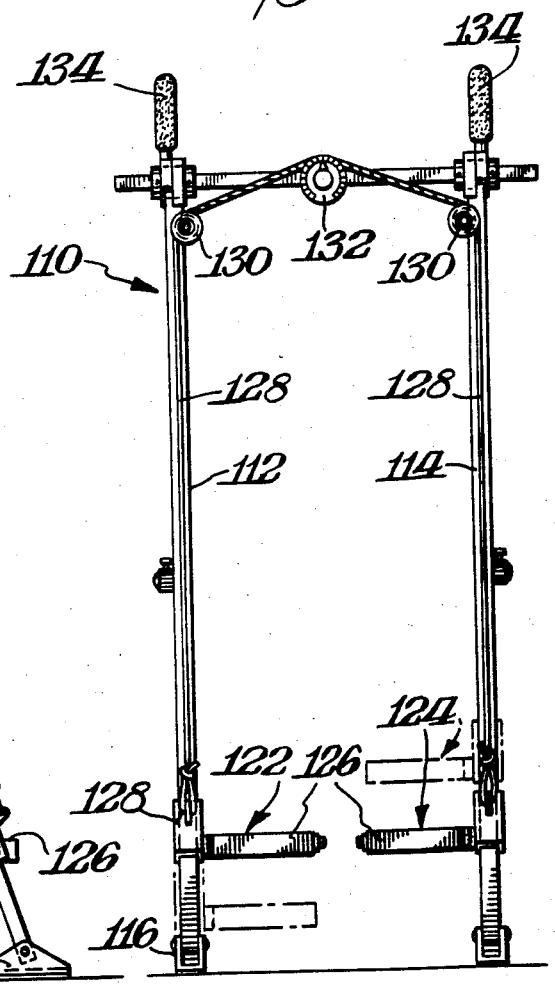
FIG. 18 is a front elevation view of the device shown in FIG. 17.

FIGS. 17–19 show one form of device 110 for achieving such continuous simulation of climbing. As indicated therein, a pair of A-shaped frames 112, 114 are provided similar to the frame members of FIGS. 11–13. Thus the frame members are pivoted at their upper ends and include self-adjusting feet 116. Each frame is provided with locking post 118 which is permanently secured to one of the frame members and adjustably secured to the other frame member by means of any suitable locking member 120. Thus the orientation or angulation of each frame may be selected and then the frame locked in place by actuation of locking member 120.

In the embodiment of FIGS. 17–19, a pair of angularly adjustable steps 122, 124 are provided. As illustrated, each step includes a horizontal foot support member 126 which is mounted to a channel 128. Each channel is guided up and down a respective frame member 112 or 114. In use the user would step up with one foot on one of said steps thus causing the step to move downwardly. Resistance means are provided to urge the steps upwardly so that when the user steps with the other foot onto the other step, the first step is raised upwardly to its normal position. FIGS. 17–19 illustrate the resistance means in the form of a cord or cable 128 threaded over pulleys 130 around friction brake 132. As illustrated in FIG. 18, if, for example, the user steps with his left foot on step 126, step 126 is moved downwardly from the position shown in full lines to the position shown in phantom. In the meantime, step 124 is pulled upwardly to the position shown in phantom. The user then shifts his weight so that the force is then applied on the right foot to step 124 and the reverse action takes place. In this manner, the user may continuously step in a forward direction while remaining at one location. Each frame also includes an upstanding hand grip 134 to provide balance to the user.

With the device of FIGS. 17–19, it is thus possible to control the angle of climbing and to control the resistance offered by friction brake 132. These factors in combination with the user's weight controls the rate of climbing. The height of the steps 124, 126 is controlled by adjusting the length of the cable 128. Thus it is possible to achieve any desired simulation of climbing. In addition, a climbing program may take into account the user applying detachable weights to the user's body as described in parent application Ser. No. 388,881 to add a further degree of resistance.

Figure 20:
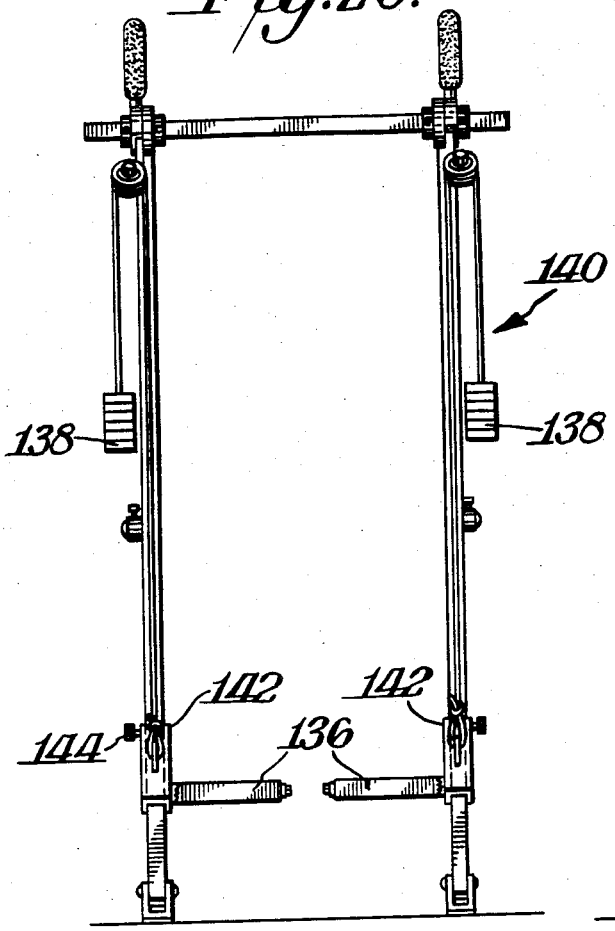
FIGS. 20–21 are front elevation views of modified forms of the device shown in FIGS. 17–19.

FIGS. 20–24 show other variations of the device described in FIGS. 17–19. In this respect, as shown in FIG. 20, each step 136 of device 140 would have an individual cable attached to it at one end thereof with the other end of the cable having a weight 138 suspended therefrom. Adjustable stops 142 would be provided on each frame to limit the upward movement of steps 136. Stops 142 may be of any suitable form such as channel members disposed around each frame and selectively locked in position by fastener 144.

Figure 21:
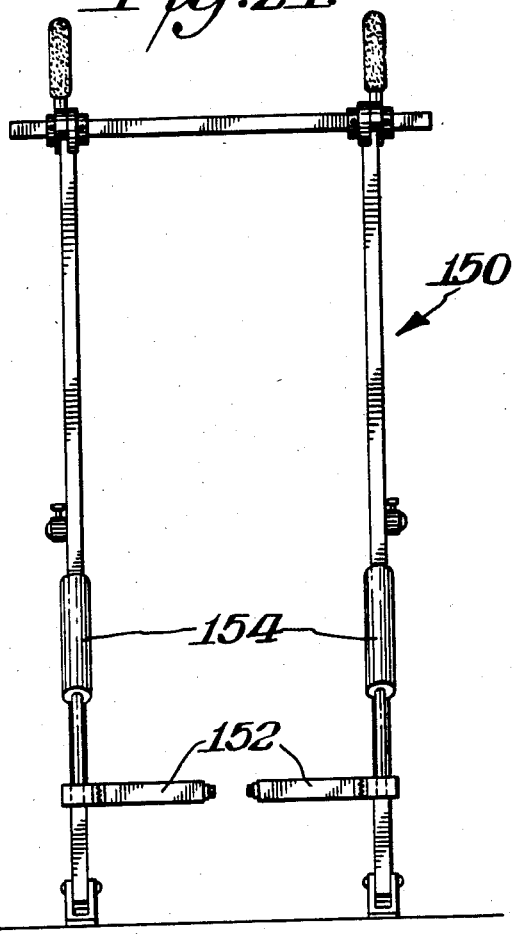

FIG. 21 shows a modification wherein the device 150 includes each step 152 mounted at the end of a hydraulic cylinder 154 so that the steps 152, 152 move up and down as the piston is extended away from or back into the cylinder.

Figure 22:
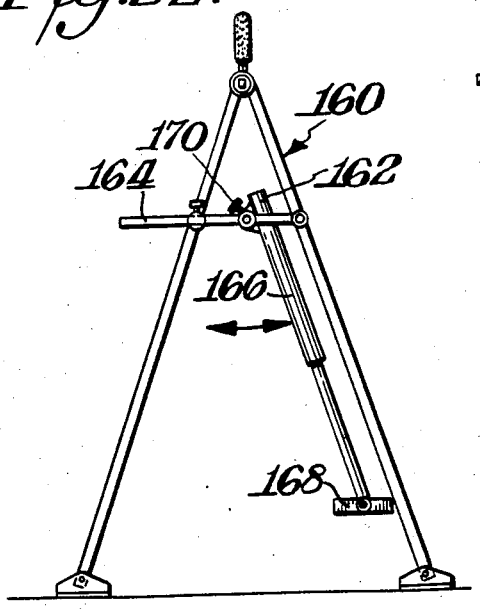
FIG. 22 is a side elevation view of yet another modified form of the device shown in FIGS. 17–19.
Figure 23:
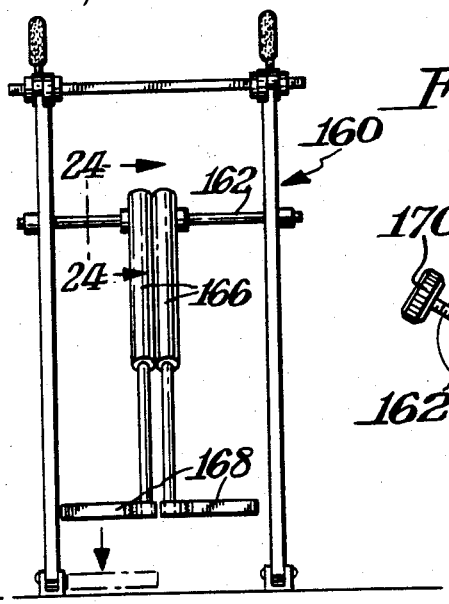
FIG. 23 is a front elevation view of the device shown in FIG. 22.
Figure 24:
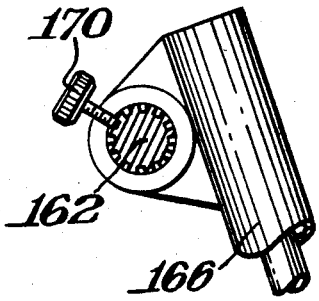
FIG. 24 is a cross-sectional view taken through FIG. 23 along the line 24—24.

FIGS. 22–24 show a further variation of a device 160 which includes a center rod 162 spanning support rods 164. A pair of hydraulic cylinders 166 are suspended from center rod 162 with the respective steps 168 mounted to the pistons of the hydraulic cylinder assembly. As shown in FIG. 24, the angle of the cylinder assemblies may be controlled by any suitable locking arrangement. As illustrated in FIG. 24, the locking arrangement includes intermeshing teeth formed between the cylinder assemblies and center rod 162 with relative rotation thereof prevented by actuation of locking member 170.

Although various embodiments illustrate hydraulic cylinders, other means of extending and retracting a piston or vertically moving the steps may be used such as tension springs or the like.

Figures 25, 26, 27:
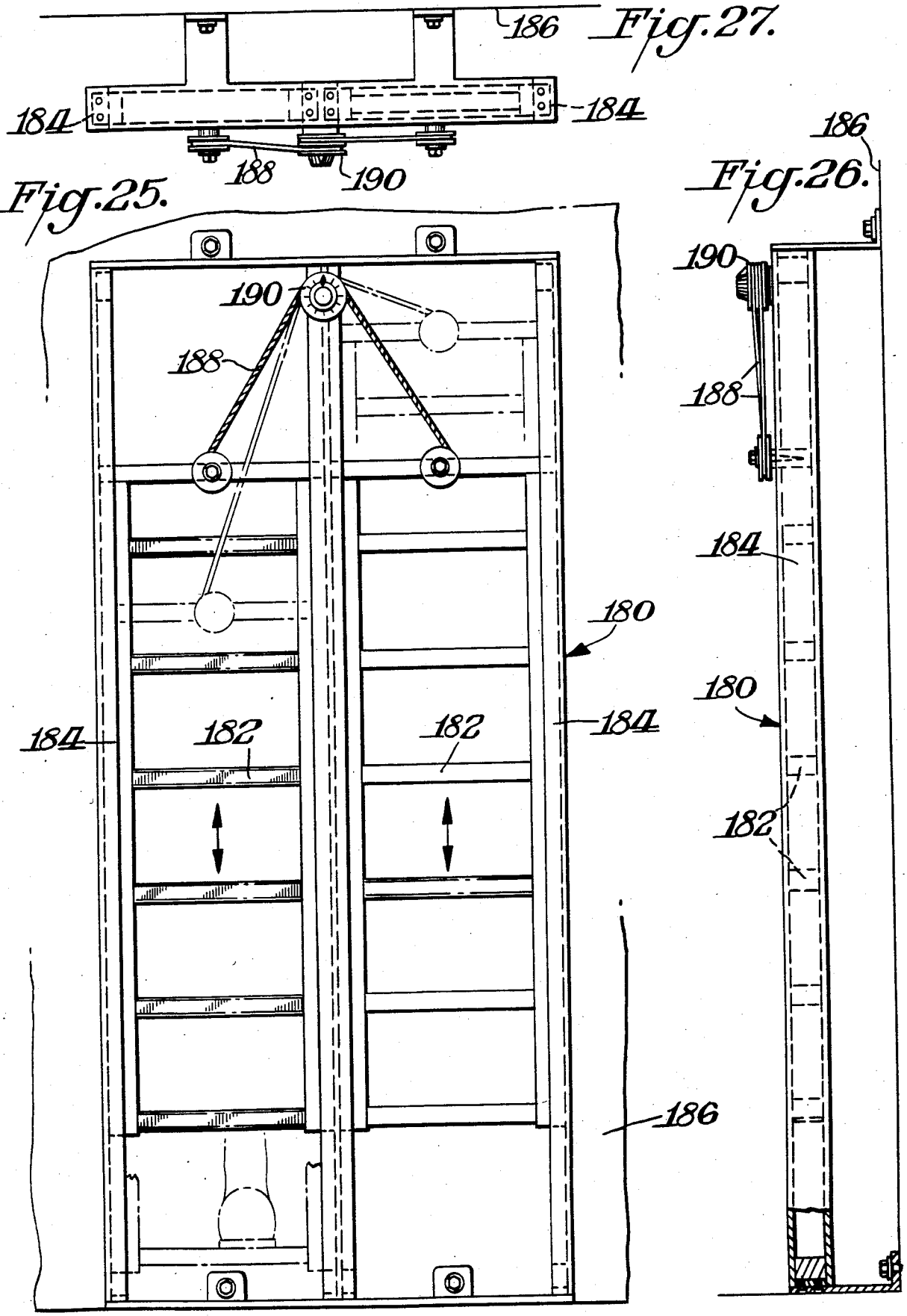
FIG. 25 is a front elevation view of still yet another device for the continuous simulation of climbing in accordance with this invention.
FIG. 26 is a side elevation view partly in section of the device shown in FIG. 24.
FIG. 27 is a top plan view of the device shown in FIGS. 25–26.

FIGS. 25–27 show yet another form of device 180 for achieving continuous simulation of climbing by providing vertically moving steps. As illustrated therein, device 180 includes a pair of movable ladders 182 slidably positioned in a channel framework 184 which in turn is secured in any suitable manner to a support member such as wall 186. The ladders 182 are interconnected by a cable 188 over a friction brake 190 in a manner similar to that described in FIGS. 17–19. The advantage of utilizing ladders 182 is that the user is presented with a number of different steps which may be used in the exercise.

Figure 29:
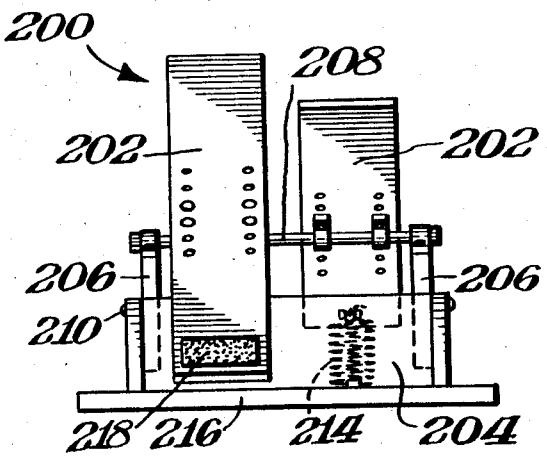
FIG. 29 is a front elevation view of the device of FIG. 28.
Figure 28:
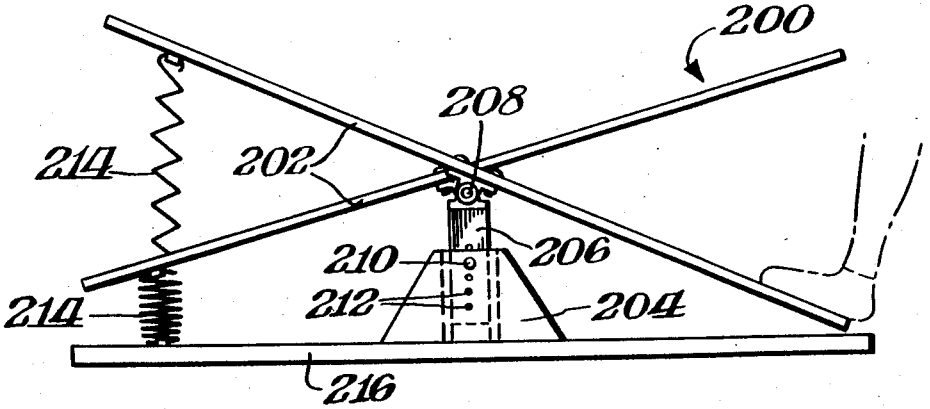
FIG. 28 is a side elevation view of yet another device for the continuous simulation of climbing in accordance with this invention.
Figure 30:
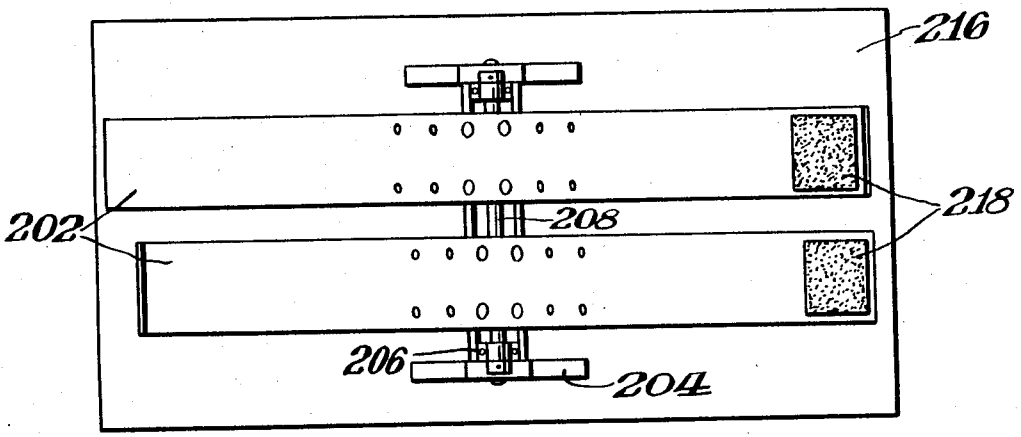
FIG. 30 is a top plan view of the device shown in FIGS. 28–29.

FIGS. 28–30 show yet another form of device 200 for providing continuous simulation of climbing by vertically movable steps. Device 200 in effect utilizes a pair of seesaws. As illustrated, device 200 includes a pair of planks 202 which pivot on frame 204. Frame 204 may take any suitable form and includes in the illustrated embodiment a pair of vertical posts 206 across which is mounted a shaft on which planks 202 are pivotally secured. Height adjustment may be achieved by elevating or lowering posts 206 and then locking the posts in position by means, for example, of a pin 210 engaged in a selective opening 212 in each respective post 206. Resistance to the downward application of force by the user stepping on planks 202 is provided in any suitable manner such as by springs 214 reacting between each plank 202 and a baseboard 216 which comprises the bottom member of support 204. Although not illustrated, planks 202 may include a plurality of mounting brackets for selective attachment of the planks with the fulcurm provided at shaft 208 so that the lever arm on each side of the fulcrum may be varied. As illustrated in FIG. 30, non-skid surfaces 218 are provided on each plank 202.

In use of the device 200 of FIGS. 28–30, the user would place his weight on one step or plank 202. As that plank 202 falls toward base member 261 in opposition to the force provided about resistance member 214, the user would step on the other plank 202 and the first plank would be returned to its original upward position. The cycle would be repeated until the desired climbing exercise is achieved.

The various devices described in connection with FIGS. 17–30 represent forms of continuous simulation of climbing wherein individual sets of steps are provided which move up and down in a generally vertical direction. The concepts of this invention, however, may also be practiced wherein the steps rotate or move in a completely closed loop direction so as to provide full or continuous simulation of climbing.

Figure 33:
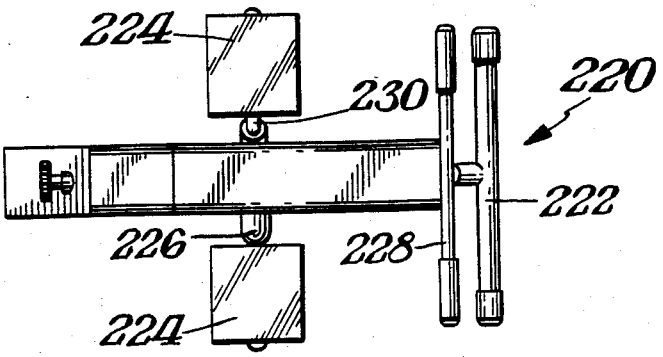
FIG. 33 is a top plan view of the device shown in FIGS. 31–32.
Figure 31:
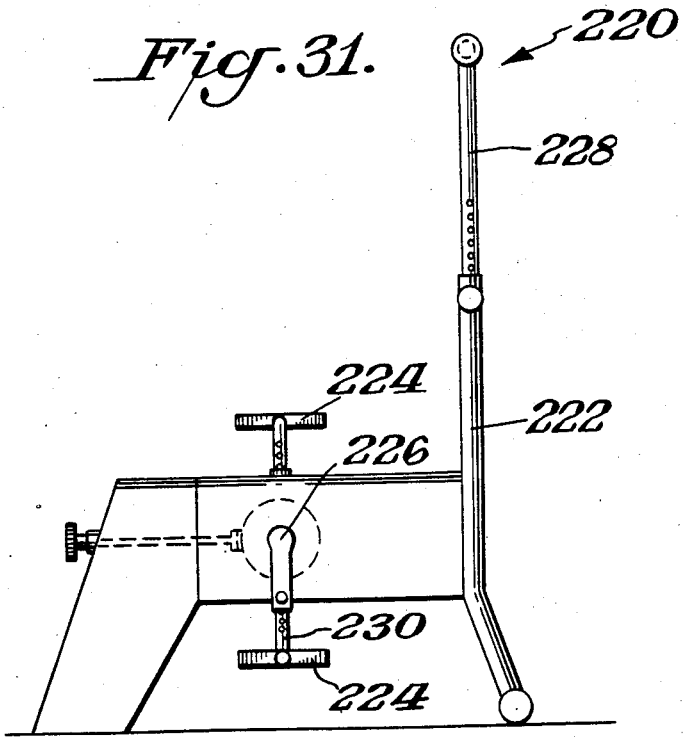
FIG. 31 is a side elevation view of still yet another device in accordance with this invention.
Figure 32:
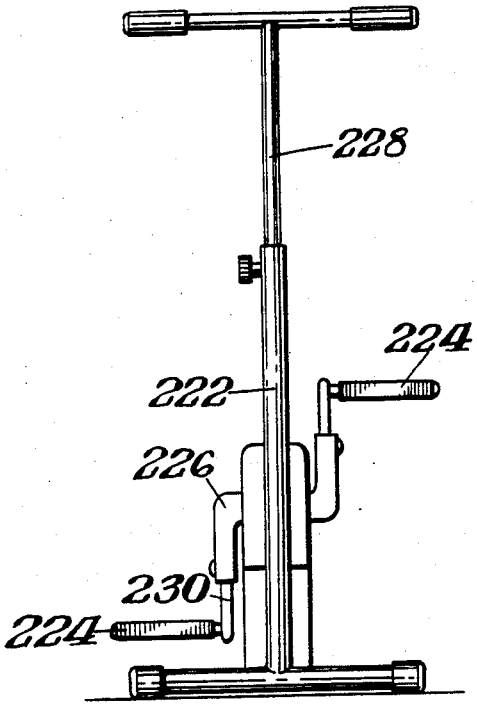
FIG. 32 is a front elevation view of the device shown in FIG. 31.

FIGS. 31–33 illustrate one such form of device 220 which utilizes the concept of steps moving in a completely circular direction. In this embodiment a frame 222 similar to a stationary bicycle is utilized. The cycle climber 220, however, differs from a stationary bicycle in that steps are substituted for pedals, a balance post replaces handle bars and a seat is completely omitted. More specifically self-leveling steps 224 are suspended from each end of shaft 226. Additionally the forward end of framework 222 is a T-shaped balance post 228. In use the user would stand fully erect bearing all of his weight on steps 224 and without the user's arms bearing any weight. Step arms 230 are secured to shaft 226 in a telescopic manner or in any other suitable manner to provide height adjustment of steps 224. If desired, some form of resistance means may also be provided at shaft 226 to resist the downward stepping action of the user on each step 224.

The concept of individual steps which move in a completely circular direction may be achieved in other members such as by including a plurality of sets of steps. This might be accomplished, for example, by mounting such sets of steps to a circular frame with the steps being self-leveling much along the lines of a ferris wheel.

Figures 34, 35, 36:
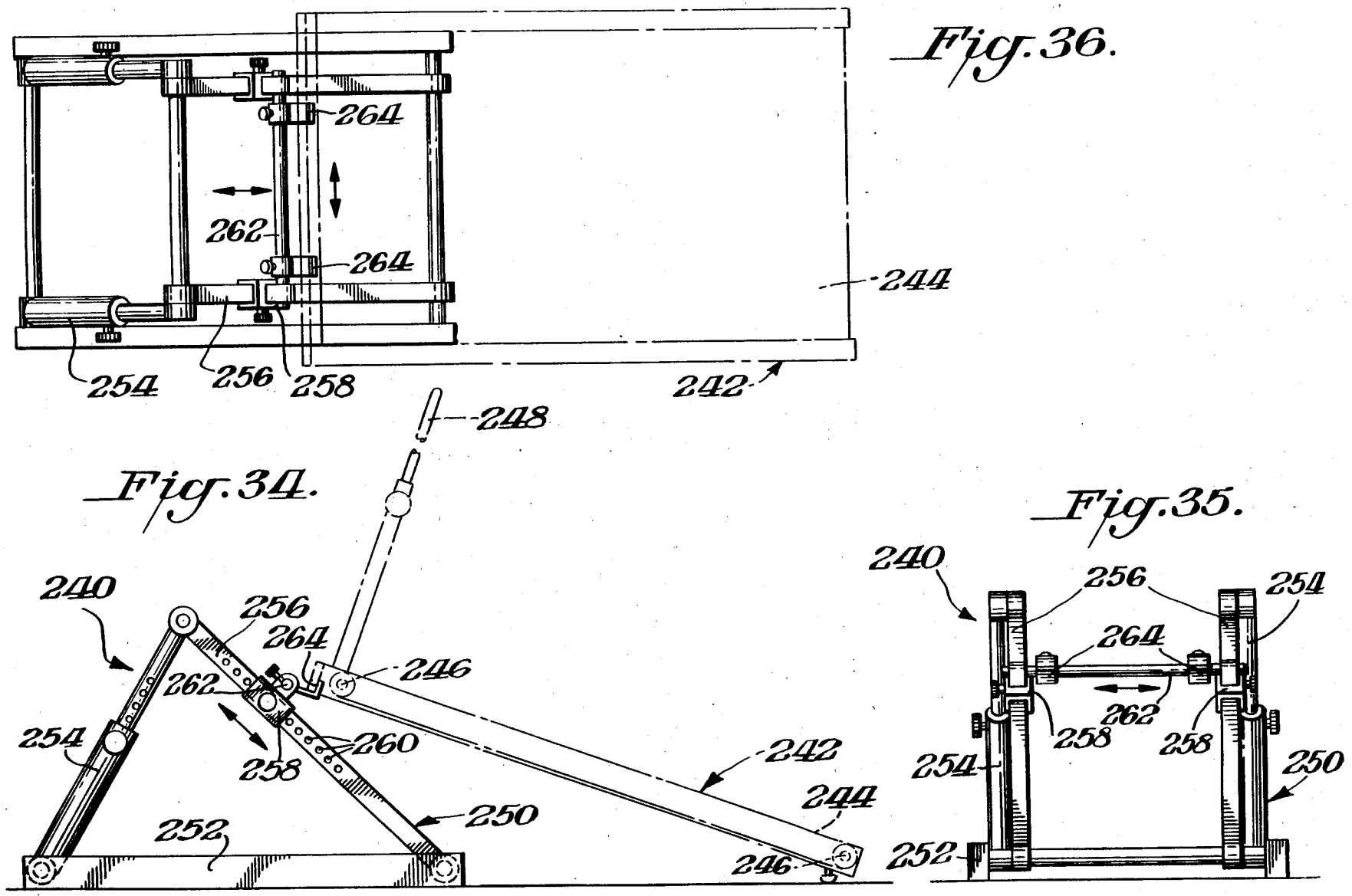
FIG. 34 is a side elevation view of still yet another form of the device for the continuous simulation of climbing.
FIG. 35 is a front elevation view of the device shown in FIG. 34.
FIG. 36 is a top plan view of the device shown in FIGS. 34–35.

FIGS. 34–36 illustrate a variation of the invention wherein a single step is provided which rotates a full cycle during use thereof. In this form of the invention, device 240 may be considered a modified treadmill climber. Device 240 may include a generally standard walker/jogger treadmill 242 which has a flexible surface 244 rotating about shafts 246. At the forward end of treadmill 242, and upstanding hand rail 248 is provided to provide balance to the user. Device 240 also includes a frame 250 for adjustably elevating the forward end of treadmill 242. Any suitable means may be utilized to accomplish the desired elevation effect. In the illustrated form frame 250 comprises a base member 252 having a telescopic assembly 254 pivotally mounted at the forward end of base 252. The telescopic assembly 254 may take various forms including a piston cylinder assembly, sets of sliding bars, an elevation screw or any other adjustable height frame. The upper end of telescopic assembly 254 has connected thereto support frame 256 which is connected at its lower end to base 252. Support frame 256 is also adjustable in length to accommodate the length adjustments of telescopic assembly 254. A bracket assembly 258 is secured on support frame 256 and treadmill 242 is mounted to a bracket 258 in any suitable manner. Bracket assembly 258 may be secured to support frame 256 at various locations in any suitable manner such as by means of fasteners engaged in selective holes 260. A shaft 262 spans brackets 258 and brackets 264 are slidably mounted on shaft 262. Treadmill 242 is detachably mounted to brackets 264. Because of their slidable mounting, brackets 264 may be laterally adjusted to add a further degree of adjustment to the location of treadmill 242. By proper adjustment of telescopic member 254 and support frame 256 as well as brackets 258 various heights may be achieved for treadmill 242 to thereby control the angle at which the user would climb treadmill 242. Although not illustrated, treadmill 242 may also include an adjustment screw or other suitable means to control the rotation speed of the roller belt 244 to provide yet a further controlled variable in the climbing exercise.

The present invention is particularly advantageous since it lends itself in a most convenient manner to adaptation in the growing search for the most complete and effective exercise. There has been a trend to provide the most aerobic exercise and conditioning in the least amount of time. The use of weights and resistance mechanisms has been promoted for the normally unused portions of the body or to add additional load on the utilized parts of the body. The use of dumbbells, ankle weights, pulleys, etc. has been advocated in conjunction with traditional forms of exercise such as walking, running, trampolining, dancing, etc. The advantage of this combined exercise is that both the arms and the legs are worked at the same time.

Climbing is ideally suited for such combined exercise since the use of additional weights does not produce added shock as in other activities. A new and highly desirable form of total exercise—resistance climbing—is made possible by the various simulated climbing devices of this invention wherein the user also can use various weights or resistance mechanisms for the upper body (particularly the arms) while performing the climbing exercise. The climbing apparati of this invention are ideally suited for use in conjunction with a load factor. The use of a wide step instead of rungs, pedals, etc. allows leg balance and thus frees the arms for additional work.

Figure 37:
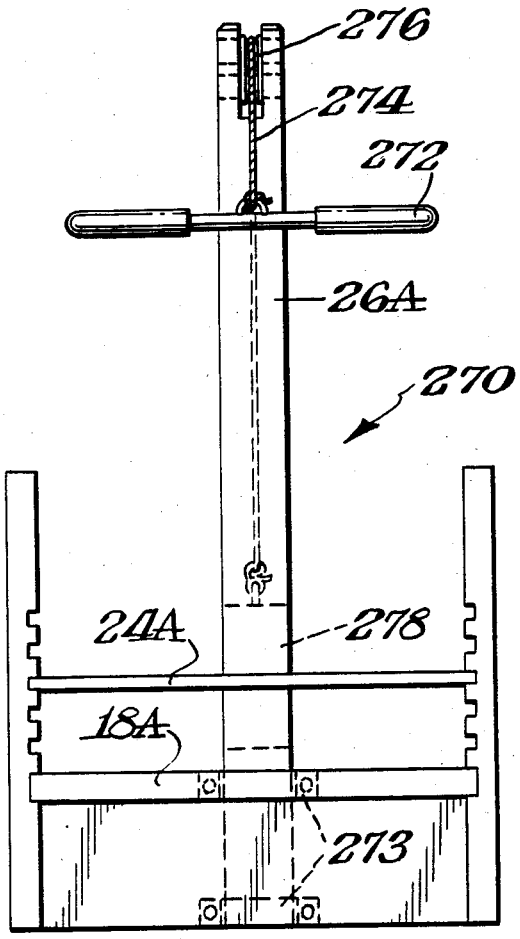
FIG. 37 is a front elevation view of yet another form of this invention.
Figure 38:
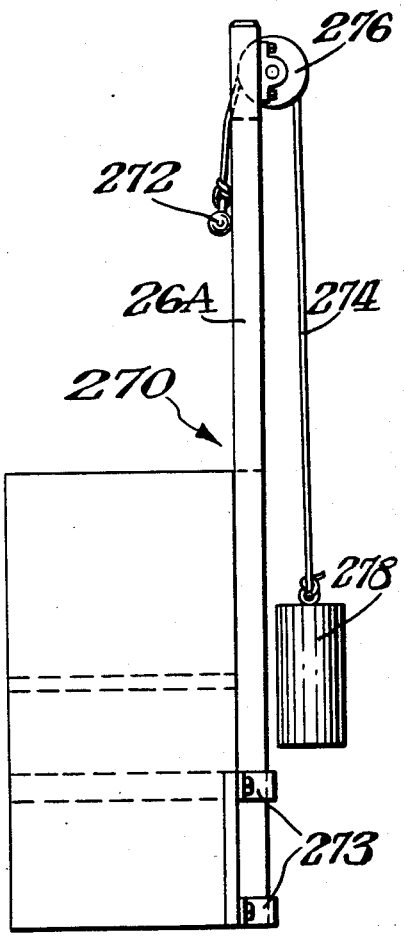
FIG. 38 is a side elevation view of the device of FIG. 37.

FIGS. 37–38 illustrate an attachable resistance pulley to exercise the arms while a person is at the same time climbing. As shown in FIGS. 37–38 device 270 is formed along generally the same principles as device 10 of FIGS. 1–3. Device 270, however, includes a hand grip bar 272 mounted to one end of a cable 274 over a pulley 276 which is secured to upstanding post 26A. Post 26A in turn is detachably mounted to the frame by brackets 273. Attached to the opposite end of cable 274 is a weight 278. In use of the device 270 the user would hold hand grip bar 272 to overcome the resistance of weight 278 while the user is stepping onto step 24A. The resistance afforded by weight 278 can be varied by simply changing the particular weight which is added to cable 274.

FIGS. 37–38 particularly illustrate the concept of resistance climbing in connection with a specific form of this invention, namely one of the devices for the partial simulation of climbing. It is to be understood, however, that the concept of resistance climbing is equally applicable to other forms of both partial simulation of climbing and full or continuous simulation of climbing. Similarly, although FIGS. 37–38 illustrate one form of adjustable resistance means for exercising the arms. Other forms of resistance mechanisms such as previously described may be employed within the concepts of this invention.

As can be appreciated, the climbing apparati of this invention thereby provide progressive exercise devices. Such use of the invention results in a superior form of exercise because it involves a natural motion, the hands are free allowing for total exercise, high aerobic value results, there is no shock since the shock of added weight is not enhanced such as in other forms of exercise (running, jumping, dancing), there is a high degree of safety because of the controlled motion, and the devices are convenient and affordable to the general public.

What is claimed is:

1. A device for the continuous simulation of climbing comprising a pair of upstanding A-shaped frames pivotally connected at their upper ends to a bridging member, right step means mounted to one of said frames for up and down movement in accordance with the user selectively applying weight on the right foot of the user which in turn is placed on said right step means, left step means mounted to the other of said frames juxtaposed said right step means for up and down movement in accordance with the user selectively applying weight on the left foot of the user which in turn is placed on said left step means, each of said A-frames comprising a pair of legs interconnected by adjustable locking means for permitting said legs to be juxtaposed each other during the inactive condition of said device and for varying the angle between said legs during the operative condition of said device to control the angle of climb of the user, a sleeve slidably mounted on one leg of each of said frames, each of said step means being a step mounted in a cantilevered manner to a respective one of said sleeves, resistance means reacting against said right step means and said left step means opposing the force applied by the user selectively stepping on said right step means and said left step means, a cable adjustably secured at one end to each of said sleeves in such a manner that the effective length of said cable may be varied to control the height of its respective step, and said resistance means reacting against said cable to thereby provide a resistance force to said steps.

2. The device of claim 1 wherein hand grip means extend upwardly from each of said upstanding frames and adjustable resistance means secured to said hand grip means for providing exercise to the user's arms while performing the climbing exercise.

3. The device of claim 1 wherein a pulley is mounted at the upper end of each of said frames, said resistance means being mounted to said bridging member, and said cable for said steps being a common cable extending from one of said steps over said pulleys and engaging said resistance means and extending to the other of said steps.

4. The device of claim 3 wherein said resistance means is a friction brake.

* * * * *